US009018842B2

(12) United States Patent
Tan et al.

(10) Patent No.: US 9,018,842 B2
(45) Date of Patent: Apr. 28, 2015

(54) DRIVING CIRCUIT AND METHOD FOR PIXEL UNIT, PIXEL UNIT AND DISPLAY APPARATUS

(71) Applicants: Boe Technology Group Co., Ltd., Beijing (CN); Chengdu Boe Optoelectronics Technology Co., Ltd., Sichuan (CN)

(72) Inventors: Wen Tan, Beijing (CN); Xiaojing Qi, Beijing (CN); Like Hu, Beijing (CN); Young Yik Ko, Beijing (CN)

(73) Assignees: Boe Technology Group Co. Ltd., Beijing (CN); Chengdu Boe Optoelectronics Technology Co., Ltd., Chengdu, Sichuan (CN)

( * ) Notice: Subject to any disclaimer, the term of this patent is extended or adjusted under 35 U.S.C. 154(b) by 83 days.

(21) Appl. No.: 13/805,728

(22) PCT Filed: Nov. 1, 2012

(86) PCT No.: PCT/CN2012/083927

§ 371 (c)(1),
(2) Date: Dec. 20, 2012

(87) PCT Pub. No.: WO2013/078931

PCT Pub. Date: Jun. 6, 2013

(65) Prior Publication Data

US 2014/0191669 A1 Jul. 10, 2014

(30) Foreign Application Priority Data

Dec. 1, 2011 (CN) ..... 2011 1 0393996

(51) Int. Cl.
*G09G 3/32* (2006.01)

(52) U.S. Cl.
CPC ..... *G09G 3/3225* (2013.01); *G09G 3/3233* (2013.01); *G09G 2300/0842* (2013.01);

(Continued)

(58) Field of Classification Search
USPC ..... 315/169.1, 169.2, 169.3; 345/76–82; 313/504; 257/40, 59
See application file for complete search history.

(56) References Cited

U.S. PATENT DOCUMENTS

2005/0258744 A1* 11/2005 Kwak et al. ..... 313/504
2006/0055336 A1* 3/2006 Jeong ..... 315/169.3

FOREIGN PATENT DOCUMENTS

CN 1744774 A 3/2006
CN 102651197 A 8/2010

(Continued)

OTHER PUBLICATIONS

International Search Report Issued Jan. 22, 2013 Appln. No. PCT/CN2012/083927.

(Continued)

*Primary Examiner* — Tung X Le
*Assistant Examiner* — Jonathan Cooper
(74) *Attorney, Agent, or Firm* — Ladas & Parry LLP

(57) ABSTRACT

The present invention provides a driving circuit and method for a pixel unit, a pixel unit and a display apparatus. The driving circuit for a pixel unit comprises: a driving thin-film transistor, a first switching element, a storage capacitor and a driving control unit; said driving control unit is used to control said storage capacitor to be charged/discharged so as to control said driving thin-film transistor to operate in a saturation region, so that the threshold voltage Vth of said driving thin-film transistor is compensated by utilizing the gate-source voltage of said driving thin-film transistor. The present invention can address the problems of ununiformity and attenuation of the brightness of OLED panel.

8 Claims, 4 Drawing Sheets

(52) U.S. Cl.
CPC ..... *G09G2300/0861* (2013.01); *G09G 2300/0819* (2013.01); *G09G 2320/0233* (2013.01); *G09G 2320/045* (2013.01)

(56) References Cited

FOREIGN PATENT DOCUMENTS

| | | | |
|---|---|---|---|
| CN | 101859536 | A | 10/2010 |
| CN | 102708791 | A | 10/2012 |
| JP | 2006309104 | A | 11/2006 |
| KR | 20100110060 | A | 10/2010 |
| KR | 20110038915 | A | 4/2011 |

OTHER PUBLICATIONS

First Chinese Office Action issued Jul. 26, 2013 Appln. No. 201110393996.3.
Second Chinese Office Action Issued Dec. 23, 2013 Appln. No. 201110393996.3.
First Korean Office Action Issued Jan. 10, 2014 Appln. No. 10-2012-7032637.
Second Korean Office Action Issued Mar. 19, 2014 Appln. No. 10-2012-7032637.
International Preliminary Report on Patentability Issued Jun. 3, 2014 Appln. No. PCT/CN2012/083927.
Korean Notice of Allowance Issued May 26, 2014 Appln. No. 10-2012-7032637.

* cited by examiner

DRIVING CIRCUIT AND METHOD FOR PIXEL UNIT, PIXEL UNIT AND DISPLAY APPARATUS

FIELD OF THE INVENTION

The present invention relates to an organic light-emitting display field, and particularly to a driving circuit and method for a pixel unit of an Active Matrix Organic Light Emitting Diode (AMOLED), a pixel unit and a display apparatus.

BACKGROUND

An existing driving circuit for a pixel unit is shown in FIG. 1. Such driving circuit comprises 2 transistors and a capacitor, wherein one transistor is a switching transistor T1, controlled by a scanning signal Vscan output from a scan line, for controlling an input of a data signal Vdata on a data line, and another transistor is a driving transistor T2 controlling light emission of an OLED; Cs is a storage capacitor for maintain a voltage applied to the driving transistor T2 during non-scanning period. The above circuit is referred to as a 2T1C driving circuit for a pixel unit.

An AMOLED is driven by a current that is generated by a driving transistor in saturation state to emit light. Because when the same gray scale voltage is input, different threshold voltages of the driving transistor lead to different driving currents, causing inconsistencies of the currents. During the manufacturing process of a Low Temperature Polycrystalline Silicon (LTPS), the uniformity of threshold voltage Vth is very bad, and at the same time the Vth drifts as well, therefore, the brightness uniformity of the traditional 2T1C driving circuit for a pixel unit has always been very bad.

SUMMARY

The present invention provides a driving circuit and method for a pixel unit, a pixel unit and a display apparatus, to improve the brightness uniformity of an OLED panel.

An embodiment of the present invention provides a driving circuit for a pixel unit, for driving an OLED, the driving circuit for a pixel unit comprises: a driving thin-film transistor, a first switching element, a storage capacitor and a driving control unit;

a first end of said storage capacitor is connected to a gate of said driving thin-film transistor, and a second end of said storage capacitor is connected to a high level output of a driving power supply;

a source of said driving thin-film transistor is connected to a data line via said first switching element;

a drain of said driving thin-film transistor is connected to an anode of said OLED and a low level output of the driving power supply respectively via said driving control unit, a source of said driving thin-film transistor is connected to said high level output of the driving power supply, and a gate of said driving thin-film transistor is connected to the drain of said driving thin-film transistor via the driving control unit;

said driving control unit is used to control said storage capacitor to be charged/discharged so as to control said driving thin-film transistor to operate in a saturation region, so that the threshold voltage Vth of said driving thin-film transistor is compensated by utilizing the gate-source voltage of said driving thin-film transistor.

In one embodiment, said driving thin-film transistor is a p-type thin-film transistor.

In one embodiment, said first switching element is a p-type thin-film transistor;

a gate of said first switching element is connected to a scan line for transmitting a control signal, a source of said first switching element is connected to a data line, and a drain of said first switching element is connected to the source of said driving thin-film transistor.

In one embodiment, said driving control unit comprises: a second switching element, a third switching element, a fourth switching element and a fifth switching element;

said second switching element is connected between the drain of said driving thin-film transistor and said low level output of the driving power supply;

said third switching element is connected between the gate of said driving thin-film transistor and the drain of said driving thin-film transistor;

said fourth switching element is connected between the drain of said driving thin-film transistor and the anode of said OLED; and said fifth switching element is connected between the source of said driving thin-film transistor and said high level output of the driving power supply.

In one embodiment, said second switching element, said third switching element, said fourth switching element and said fifth switching element are p-type TFTs;

a gate of said second switching element is connected to a first control line, a source of said second switching element is connected to the drain of said driving thin-film transistor, and a drain of said second switching element is connected to said low level output of the driving power supply;

a gate of said third switching element is connected to said scan line, a source of said third switching element is connected to the gate of said driving thin-film transistor, and a drain of said third switching element is connected to the drain of said driving thin-film transistor;

a gate of said fourth switching element is connected to a second control line, a source of said fourth switching element is connected to the drain of said driving thin-film transistor, and a drain of said fourth switching element is connected to the anode of said OLED;

a gate of said fifth switching element is connected to said second control line, a source of said fifth switching element is connected to said high level output of the driving power supply, and a drain of said fifth switching element is connected to the source of said driving thin-film transistor.

The present invention also provides a method for driving a pixel unit, and it is applied to the above driving circuit for pixel unit, said method for driving a pixel unit comprising the steps of:

pixel charging: by a driving control unit controlling a storage capacitor to be charged;

pixel discharging: by the driving control unit controlling said storage capacitor to be discharged via the driving thin-film transistor, until a gate-source voltage of said driving thin-film transistor is equal to the threshold voltage Vth of said driving thin-film transistor;

switch buffering: by the driving control unit controlling the gate voltage of the driving thin-film transistor to remain stable;

driving the OLED to emit light and display: by said driving control unit controlling said driving thin-film transistor to operate in a saturation region, and controlling the voltage difference between two ends of said storage capacitor to remain unchanged, so as to compensate the threshold voltage Vth of said driving thin-film transistor by the gate-source voltage of said driving thin-film transistor, and to drive OLED to emit light by said driving thin-film transistor.

In one embodiment, the step for pixel charging comprises: by a first switching element switching on a connection between the source of said driving thin-film transistor and a data line; by said driving control unit switching on a connection between the drain of said driving thin-film transistor and a cathode of said OLED, switching on a connection between the gate of said driving thin-film transistor and the drain of said driving thin-film transistor, switching off the connection between the source of said driving thin-film transistor and said high level output of the driving power supply, and controlling said storage capacitor to be charged;

the step for pixel discharging comprises: by said driving control unit switching off the connection between the drain of said driving thin-film transistor and the cathode of said OLED, by said driving control unit controlling said storage capacitor to be discharged via said driving thin-film transistor, until a gate-source voltage of said driving thin-film transistor is equal to the threshold voltage Vth of said driving thin-film transistor;

the step for switch buffering comprises: by said first switching element switching off the connection between the source of said driving thin-film transistor and the data line; by said driving control unit switching off the connection between the gate of said driving thin-film transistor and the drain of said driving thin-film transistor;

the step for driving the OLED to emit light and display comprises: by said driving control unit switching on a connection between the source of said driving thin-film transistor and said high level output of the driving power supply, switching on a connection between the drain of said driving thin-film transistor and the anode of said OLED, controlling said driving thin-film transistor to operate in the saturation region, and controlling voltage difference between two ends of said storage capacitor to remain unchanged, so as to compensate the threshold voltage Vth of said driving thin-film transistor by the gate-source voltage of said driving thin-film transistor, and to drive OLED to emit light by said driving thin-film transistor.

An embodiment of the present invention also provides a pixel unit, comprising: an OLED and the driving circuit for a pixel unit stated above, wherein the driving circuit for a pixel unit is connected to an anode of OLED, a cathode of OLED is connected to a low level output of the driving power supply.

An embodiment of the present invention also provides a display apparatus, comprising a plurality of pixel units stated above.

Compared to prior art, in the driving circuit and method for a pixel unit, the pixel unit and the display apparatus provided by the embodiments of the present invention, by the driving control unit controlling the storage capacitor Cs to be discharged so as to compensate the threshold voltage of the driving thin-film transistor for driving OLED by a gate-source voltage of the driving thin-film transistor, solving the problems of the ununiformity and attenuation of the brightness in an OLED panel.

DETAILED DESCRIPTION

The present invention provides a driving circuit and method for a pixel unit, a pixel unit and a display apparatus, wherein, by using a diode connection and controlling the storage capacitor to be discharged, it allows the gate-source voltage of a driving thin-film transistor for driving the OLED to compensate the threshold voltage of the driving thin-film transistor, so as to address the issues of ununiformity and attenuation of the brightness in the OLED panel.

Figure 1:
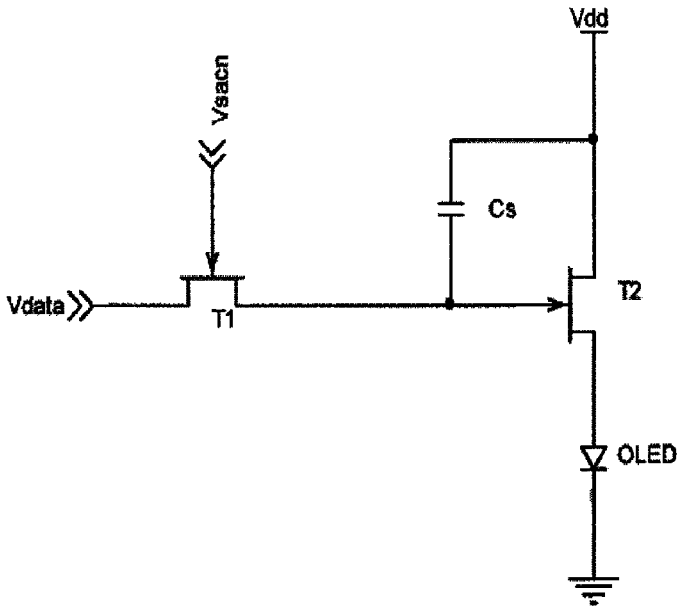
FIG. 1 shows a circuit diagram of an existing 2T1C driving circuit for a pixel unit.
Figure 2:
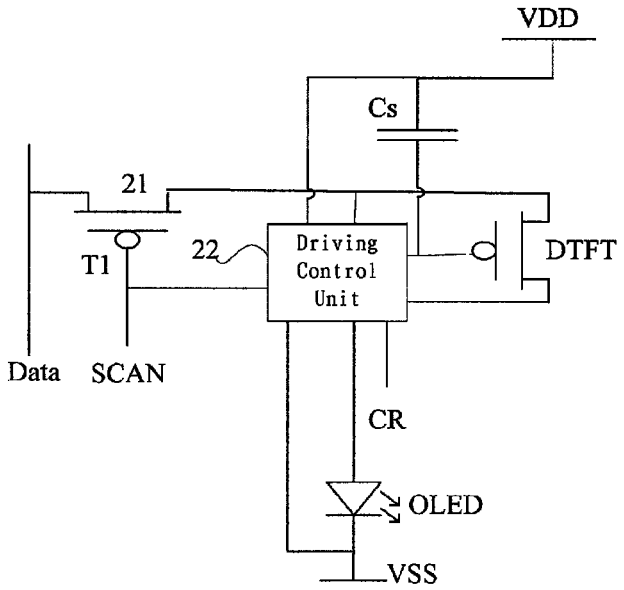
FIG. 2 shows a circuit diagram of a driving circuit for a pixel unit according to the first embodiment of the present invention.

Shown in FIG. 2, in the circuit diagram of the driving circuit for a pixel unit according to the first embodiment of the present invention, the driving circuit for a pixel unit of the embodiment is used to drive an OLED, and the circuit comprises a driving thin-film transistor DTFT, a first switching element 21, a storage capacitor Cs and a driving control unit 22; wherein a first end of the storage capacitor is connected to a gate of the driving thin-film transistor DTFT, and a second end of said storage capacitor is connected to a high level output of a driving power supply having an output voltage of VDD;

a source of the driving thin-film transistor DTFT is connected to a data line Data via said first switching element 21;

a drain of the driving thin-film transistor DTFT is connected to an anode of said OLED and a low level output of the driving power supply having an output voltage of VSS respectively via the driving control unit 22, a source of the driving thin-film transistor DTFT is connected to the high level output of the driving power supply via the driving control unit 22, and a gate of the driving thin-film transistor is connected to the drain of the driving thin-film transistor via the driving control unit 22;

the driving control unit 22 is used to control said storage capacitor Cs to be charged/discharged to control said driving thin-film transistor DTFT to operate in a saturation region, so as to compensate the threshold voltage Vth of said driving thin-film transistor DTFT by utilizing the gate-source voltage of said driving thin-film transistor DTFT;

the driving control unit 22 is also connected to a scan line SCAN and a control line CR for transmitting control signals, respectively.

As shown in FIG. 2, in the driving circuit for a pixel unit of the first embodiment of the present invention, the first switching element 21 is a first switch TFT labeled as T1, and T1 is a p-type thin-film transistor.

A gate of the first switching element 21 is connected to a scan line SCAN for transmitting a control signal, a source of the first switching element 21 is connected to the data line Data, and a drain of the first switching element 21 is connected to the source of the driving thin-film transistor DTFT.

Figure 3A:
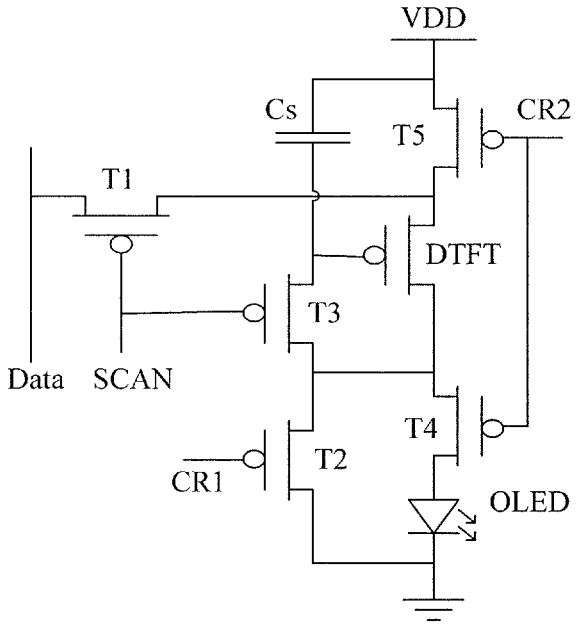
FIG. 3A shows a circuit diagram of a driving circuit for a pixel unit according to the second embodiment of the present invention.

Shown in FIG. 3A, it is the circuit diagram of the driving circuit for a pixel unit according to the second embodiment of the present invention. The driving circuit for a pixel unit in this embodiment employs a 6T1C circuit, wherein the threshold voltage Vth of the driving TFT is compensated so that the driving current of the driving TFT is independent of the threshold voltage Vth of the driving TFT, and thus achieves the consistency of the current, the improved uniformity and reliability.

In this embodiment, the first switching element is a first switch TFT labeled as T1, the second switching element is a second switch TFT labeled as T2, the third switching element is a third switch TFT labeled as T3, the fourth switching element is a fourth switch TFT labeled as T4, the fifth switching element is a fifth switch TFT labeled as T5, and the driving TFT is labeled as DTFT, wherein, the first switch TFT, the second switch TFT, the third switch TFT, the fourth switch TFT and the driving TFT are p-type TFTs, and the threshold voltage of the p-type TFT, Vth<0;

a drain of T4 is connected to an anode of the OLED, a source of T4 is connected to a drain of DTFT, a source of T2 and a drain of T3, and a gate of T4 is connected to a gate of T5;

a drain of T2 is connected to a cathode of OLED and to ground;

a source of T3 is connected to a gate of DTFT and a first end of the storage capacitor Cs, and a gate of T3 is connected to a gate of T1;

a drain of T1 is connected to a drain of T5, and a source of T1 is connected to a data line Data;

a source of T5 is connected to a high level output of a driving power supply having a output voltage of VDD, and a drain of T5 is connected to a source of DTFT;

a gate of T3 and a gate of T1 are connected to a scan line SCAN for transmitting a control signal;

a gate of T2 is connected to a control line CR1; and a gate of T4 and a gate of T5 are connected to a control line CR2.

Figure 3B:
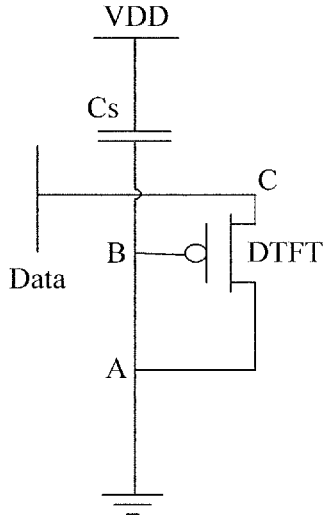
FIG. 3B shows an equivalent circuit diagram of the driving circuit for a pixel unit according to the second embodiment of the present invention in a first time period.

As shown in FIG. 3B, when the driving circuit for a pixel unit of the second embodiment of the present invention is in operation, during the first time period (i.e. the pre-charging stage), the scan line SCAN and the control line CR1 output a low level, to control T2, T3 and T1 to switch on, and the control line CR2 is at a high level, to control T4 and T5 to cut off. At this time, the first end of the storage capacitor Cs is connected to ground, the second end of the storage capacitor Cs is connected to the high level output of the driving power supply having the output voltage of VDD, and the storage capacitor Cs is charged; the voltage at the node A (i.e. the drain of DTFT) and that at the node B (i.e. the gate of DTFT) are 0, and the voltage at the node C (i.e. the source of DTFT) is a voltage Vdata output from the data line Data.

Figure 3C:
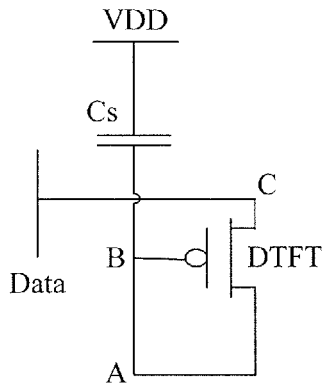
FIG. 3C shows an equivalent circuit diagram of the driving circuit for a pixel unit according to the second embodiment of the present invention in a second time period.

As shown in FIG. 3C, when the driving circuit for a pixel unit of the second embodiment of the present invention is in operation, during the second time period (i.e. data write-in and discharge compensation stage), the scan line SCAN outputs a low level, to control T3 and T1 to switch on, and the control line CR1 and control line CR2 output a high level, to control T4, T2 and T5 to cut off. The gate and drain of DTFT are connected together, and thus the DTFT serves as a diode; the first end of the storage capacitor Cs is connected to the gate of DTFT, and the second end of the storage capacitor Cs is connected to the high level output of the driving power supply having the output voltage of VDD; meanwhile, the source of DTFT (i.e. node C) is connected to the data line Data outputting a voltage Vdata.

The gate-source voltage of DTFT Vgs (i.e. (VB−VC)) is equal to (−Vdata), which is less than Vth, and therefore DTFT is switched on; the storage capacitor Cs discharges to the data line Data via DTFT, until the Vgs of DTFT increases to the threshold voltage Vth of the DTFT; at this time. DTFT enters into subthreshold turn-on, the voltage at the node C maintains at Vdata, the voltage difference between node B and node C (i.e. Vgs) is equal to the threshold voltage Vth of DTFT. Therefore, the gate voltage of DTFT (i.e. node B) is VD+Vth=Vdata+Vth, and the voltage difference between the second end and the first end of the storage capacitor Cs is VDD−VB, i.e. VDD−Vdata−Vth.

Figure 3D:
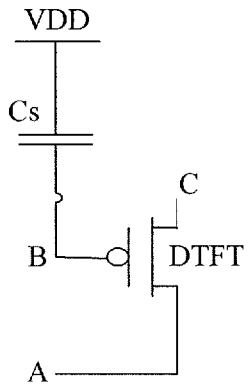
FIG. 3D shows an equivalent circuit diagram of the driving circuit for a pixel unit according to the second embodiment of the present invention in a third time period.

As shown in FIG. 3D, when the driving circuit for a pixel unit of the second embodiment of the present invention is in operation, during the third time period (i.e. switch buffering stage), the scan line SCAN, the control line CR1 and the control line CR2 output a high level, to control T1, T2, T3, T4 and T5 to switch off, and the voltage at the gate of DTFT (i.e. node B) is stabilized by the storage capacitor to be (Vdata+Vth).

Figure 3E:
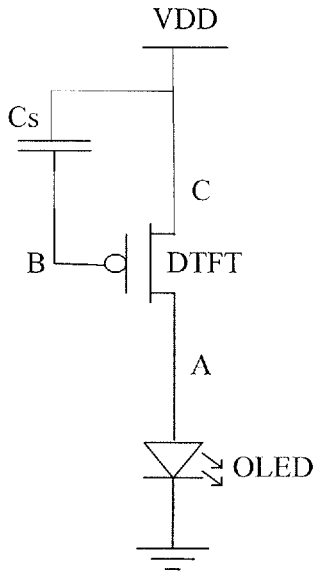
FIG. 3E shows an equivalent circuit diagram of the driving circuit for a pixel unit according to the second embodiment of the present invention in a fourth time period.

As shown in FIG. 3E, when the driving circuit for a pixel unit of the second embodiment of the present invention is in operation, during the fourth time period (i.e. the driving stage for OLED), the control line CR2 outputs a low level, to control T4 and T5 to switch on, and the control line CR1 and the scan line SCAN output a high level, to control T2, T3 and T1 to switch off. At this time, DTFT operates in a saturation region, and a driving current flows through OLED to light it up.

The gate voltage of DTFT (i.e. node B) is (Vdata+Vth), the source of DTFT is connected to the high level output of the driving power supply having a output voltage of VDD via T5, i.e. the gate-source voltage of DTFT Vgs is (Vdata+Vth−VDD), and the current I flowing through OLED at this moment is calculated by equation (1) as below:

$$\begin{aligned} I &= K\times(Vgs-Vth)^2 \\ &= K\times(Vdata+Vth-VDD-Vth)^2 \\ &= K\times(Vdata-VDD)^2; \end{aligned} \qquad \text{Equation (1)}$$

wherein, K is the current coefficient of DTFT;

$$K=C_{ox}\cdot\mu\cdot W/L;$$

μ, $C_{ox}$, W and L are field effect mobility, gate isolation layer unit-area capacitance, channel width and length of DTFT respectively.

The fourth time period is a light-emitting stage of OLED, and OLED will continue to emit light until the written-in of a next frame data on the data line Data.

Therefore, the driving current of the driving TFT (i.e. the current that flows through OLED) only depends on Vdata−VDD, and is not affected by the threshold voltage Vth of the driving TFT and the anode voltage Vth_oled of OLED, preventing the driving current from varying according to the drift of the threshold voltage of the driving TFT and that of the anode voltage of OLED, so that the uniformity of current is improved, to achieve the uniformity of the brightness of the OLED panel.

Figure 4:
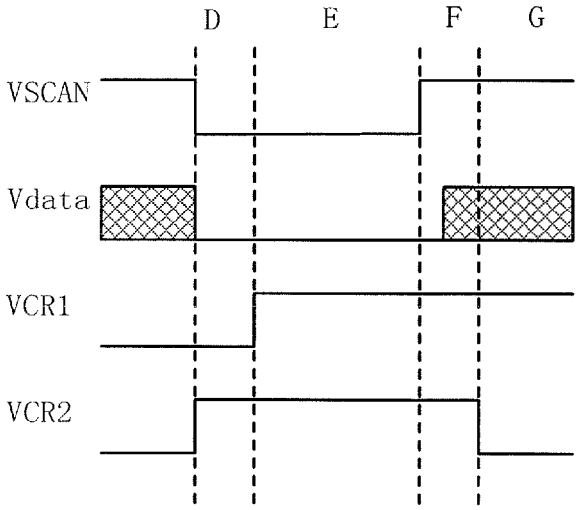
FIG. 4 shows a timing diagram of various signals in the driving circuit for a pixel unit of the embodiment.

FIG. 4 shows a timing diagram of various signals in the driving circuit for a pixel unit of the embodiment, wherein the scan line SCAN outputs the scan signal VSCAN, the data line DATA outputs a data signal Vdata, the first control line CR1 outputs a control signal VCR1 and the second control line CR2 outputs a control signal VCR2. In the FIG. 4, D, E, F and G indicate the first time period, the second time period, the third time period and the fourth time period respectively.

The above description is only illustration for the present invention and it is not restrictive in any way. It should be appreciated that the ordinary skilled in the art will be able to make a various of modifications, variations and equivalences without departing from the spirit and scope defined in the appended claims, and they all fall into the claimed scope of the present invention.

What is claimed is:

1. A driving circuit for a pixel unit, for driving an OLED, wherein, the driving circuit for the pixel unit comprises: a driving thin-film transistor, a first switching element, a storage capacitor and a driving control unit;

wherein, a first end of said storage capacitor is connected to a gate of said driving thin-film transistor, and a second end of said storage capacitor is connected to a high level output of a driving power supply;

a gate of said first switching element is connected to a scan line for transmitting a control signal, a source of said first switching element is connected to the data line, and a drain of said first switching element is connected to the source of said driving thin-film transistor;

a source of said driving thin-film transistor is connected to a data line via said first switching element;

a drain of said driving thin-film transistor is connected to an anode of said OLED and a low level output of the driving power supply respectively via said driving control unit, a source of said driving thin-film transistor is connected to said high level output of the driving power supply via said driving control unit, and a gate of said driving thin-film transistor is connected to the drain of said driving thin-film transistor via said driving control unit;

said driving control unit, for controlling said storage capacitor to be charged and/or discharged to control said driving thin-film transistor to operate in a saturation region, so as to compensate a threshold voltage Vth of said driving thin-film transistor by a gate-source voltage of said driving thin-film transistor; wherein said driving control unit comprises: a second switching element, a third switching element, a fourth switching element and a fifth switching element;

a gate of said second switching element is connected to a first control line, a source of said second switching element is connected to the drain of said driving thin-film transistor, and a drain of said second switching element is directly connected to said low level output of the driving power supply;

a gate of said third switching element is connected to the scan line, a source of said third switching element is connected to the gate of said driving thin-film transistor, and a drain of said third switching element is connected to the drain of said driving thin-film transistor;

a gate of said fourth switching element is connected to a second control line, a source of said fourth switching element is connected to the drain of said driving thin-film transistor, and a drain of said fourth switching element is connected to the anode of said OLED; and a gate of said fifth switching element is connected to said second control line, a source of said fifth switching element is connected to said high level output of the driving power supply, and a drain of said fifth switching element is connected to the source of said driving thin-film transistor.

2. The driving circuit for the pixel unit of claim 1, wherein, said driving thin-film transistor is a p-type thin-film transistor.

3. The driving circuit for the pixel unit of claim 2, wherein, said first switching element is a p-type thin-film transistor.

4. The driving circuit for the pixel unit of claim 3, wherein, said second switching element is connected between the drain of said driving thin-film transistor and said low level output of the driving power supply;

said third switching element is connected between the gate of said driving thin-film transistor and the drain of said driving thin-film transistor;

said fourth switching element is connected between the drain of said driving thin-film transistor and the anode of said OLED; and said fifth switching element is connected between the source of said driving thin-film transistor and said high level output of the driving power supply.

5. The driving circuit for the pixel unit of claim 4, wherein, said second switching element, said third switching element, said fourth switching element and said fifth switching element are p-type TFTs.

6. A method for driving a pixel unit, being applied to the driving circuit for the pixel unit of claim 1, wherein, said method for driving a pixel unit comprising the steps of:

pixel charging: by a driving control unit controlling a storage capacitor to be charged;

pixel discharging: by the driving control unit controlling said storage capacitor to be discharged via the driving thin-film transistor, until a gate-source voltage of said driving thin-film transistor is equal to the threshold voltage Vth of said driving thin-film transistor;

switch buffering: by the driving control unit controlling the gate voltage of the driving thin-film transistor to remain stable;

driving the OLED to emit light and display: by said driving control unit controlling said driving thin-film transistor to operate in a saturation region, and controlling the voltage difference between two ends of said storage capacitor to remain unchanged, so as to compensate the threshold voltage Vth of said driving thin-film transistor by the gate-source voltage of said driving thin-film transistor, and to drive OLED to emit light by said driving thin-film transistor.

7. The method for driving the pixel unit according to claim 6, wherein, the step for pixel charging comprises: by a first switch element switching on a connection between the source of said driving thin-film transistor and a data line; by said driving control unit switching on a connection between the drain of said driving thin-film transistor and a cathode of said OLED, switching on a connection between the gate of said driving thin-film transistor and the drain of said driving thin-film transistor, switching off the connection between the source of said driving thin-film transistor and said high level output of the driving power supply, and controlling said storage capacitor to be charged;

the step for pixel discharging comprises: by said driving control unit switching off the connection between the drain of said driving thin-film transistor and the cathode of said OLED, by said driving control unit controlling said storage capacitor to be discharged via said driving thin-film transistor, until a gate-source voltage of said driving thin-film transistor is equal to the threshold voltage Vth of said driving thin-film transistor;

the step for switch buffering comprises: by said first switching element switching off the connection between the source of said driving thin-film transistor and the data line; by said driving control unit switching off the connection between the gate of said driving thin-film transistor and the drain of said driving thin-film transistor;

the step for driving OLED to emit light and display comprises: by the driving control unit switching on a connection between the source of said driving thin-film transistor and said high level output of the driving power supply, switching on a connection between the drain of said driving thin-film transistor and the anode of said OLED, controlling said driving thin-film transistor to operate in the saturation region, and controlling the voltage difference between two ends of said storage capacitor to remain unchanged, so as to compensate the threshold voltage Vth of said driving thin-film transistor by the gate-source voltage of said driving thin-film transistor, and to drive OLED to emit light by said driving thin-film transistor.

8. A pixel unit comprising an OLED and the driving circuit for the pixel unit of claim 1, wherein, the driving circuit for the pixel unit is connected to an anode of OLED, and a cathode of OLED is connected to the low level output of the driving power supply.

* * * * *